United States Patent [19]

Rupp

[11] Patent Number: 4,529,978

[45] Date of Patent: Jul. 16, 1985

[54] METHOD AND APPARATUS FOR GENERATING GRAPHIC AND TEXTUAL IMAGES ON A RASTER SCAN DISPLAY

[75] Inventor: Charle' Rupp, Bolton, Mass.

[73] Assignee: Digital Equipment Corporation, Maynard, Mass.

[21] Appl. No.: 503,865

[22] Filed: Jun. 13, 1983

Related U.S. Application Data

[63] Continuation of Ser. No. 201,365, Oct. 27, 1980, abandoned.

[51] Int. Cl.[3] ..... G09G 1/16

[52] U.S. Cl. ..... 340/727; 340/735; 340/739

[58] Field of Search ..... 340/703, 739, 735, 727, 340/743, 736, 732, 723

[56] References Cited

U.S. PATENT DOCUMENTS

| | | | |
|---|---|---|---|
| 2,910,681 | 10/1959 | Mita | 340/743 |
| 3,430,207 | 2/1969 | Davis . | |
| 3,510,865 | 5/1970 | Callahan et al. | 340/741 |
| 3,573,789 | 4/1971 | Sharp et al. | 340/728 |
| 3,588,872 | 6/1971 | Kolb . | |
| 3,614,767 | 10/1971 | Carrell . | |
| 3,624,634 | 11/1971 | Clark | 340/703 |
| 3,685,038 | 8/1972 | Flanagan | 340/703 |
| 3,742,288 | 6/1973 | Albrecht et al. . | |
| 3,772,677 | 11/1973 | Sommer . | |
| 3,781,850 | 12/1973 | Gicca et al. . | |
| 3,786,477 | 1/1974 | Baumgartner | 340/735 |
| 3,906,480 | 9/1975 | Schwartz | 340/739 |
| 3,925,765 | 12/1975 | Berwin et al. . | |
| 3,925,776 | 12/1975 | Swallow . | |
| 3,944,997 | 3/1976 | Swallow | 340/703 |
| 3,958,232 | 5/1976 | Hobrough et al. . | |
| 4,107,664 | 8/1978 | Marino | 340/731 |
| 4,127,850 | 11/1978 | Vallias | 340/727 |
| 4,168,488 | 9/1979 | Evans . | |
| 4,206,457 | 6/1980 | Weisbecker et al. | 340/703 |
| 4,225,861 | 9/1980 | Langdon, Jr. et al. | 340/703 |
| 4,228,432 | 10/1980 | Osborne | 340/736 |
| 4,233,601 | 11/1980 | Hankins et a. | 340/703 |
| 4,240,073 | 12/1980 | Seats et al. | 340/703 |
| 4,245,321 | 1/1981 | Gennetten | 364/521 |
| 4,249,171 | 2/1981 | Batcher | 340/727 |
| 4,278,972 | 7/1981 | Wozniak | 340/703 |
| 4,360,884 | 11/1982 | Okada et al. | 340/739 |

*Primary Examiner*—Marshall M. Curtis

*Attorney, Agent, or Firm*—Cesari and McKenna

[57] ABSTRACT

An image of a two-dimensional matrix to be displayed is formed in a refresh memory entirely by the execution of sequences of "pattern modulated" line segments termed "vectors". Two sequences of vectors are generated for writing each character cell into the refresh memory. The first, or outer, sequence provides the starting position and pattern for each of the vectors in a second, or inner, sequence. The inner and outer vectors are generated, respectively by inner and outer vector generators. Both inner and outer vectors are drawn from a current, starting position in a selected direction to an end point position a given length away, based upon the contents of definable registers in the image generating hardware. One of the registers identifies the data to be written into the successive pixel locations in memory selected by the vector generators during the writing of each line segment.

Characters are drawn by breaking the two-dimensional character pattern into a set of nested one-dimensional patterns, which are related to columns and rows. Each row of the character pattern is drawn by generating an inner vector at an angle and length selected for the cell. The vector length is set equal to the width of the character and other variables are set appropriately to generate the desired angle. A second vector generating procedure is used to create a vector which, instead of providing illumination points, provides the starting (x,y) location to be used for drawing each successive inner vector in the matrix. This vector, too, has a starting location, length spatial orientation, and a pattern. The angle of the outer vector can be set independently of the angle of the inner vector. The direction, repetition, and location of these sequences may be varied dynamically, creating the ability to vary the size, angular orientation and spacing of characters, as well as font, plus providing other text enhancements.

12 Claims, 25 Drawing Figures

```
(* HORIZONTAL STRAIGHT LINE *)
LDX(X);
LDY(Y);          (* LOAD THE INITIAL X AND Y COORDINATES *)
LDMODE(1);       (* SET THE WRITING MODE *)
LDPAT(1);        (* SET THE PATTERN TO FILL WITH "1"  's *)
EXDOT;           (* WRITE THE INITIAL PIXEL *)
FOR REP :  =  1 TO DU DO

     BEGIN
      X: = X + 1;
      LDX (X);
      EXDOT
     END;
```

*Fig. 9*

```
(* PVMOVE PROCEDURE *)
PROCEDURE PVMOVE (DIR: 0...7);
BEGIN
 CASE DIR OF
  0:  BEGIN GX: = GX + 1                    END;
  1:  BEGIN GX: = GX + 1; GY: = GY + 1 END;
  2:  BEGIN              ; GY: = GY + 1 END;
  3:  BEGIN GX: = GX - 1; GY: = GY + 1 END;
  4:  BEGIN GX: = GX - 1                    END;
  5:  BEGIN GX: = GX - 1; GY: = GY - 1 END;
  6:  BEGIN               GY: = GY - 1 END;
  7:  BEGIN GX: = GX + 1; GY: = GY - 1 END;
 END
END;
```

*Fig. 10*

```
(* MAJOR DIRECTION VECTOR DRAW *)
PROCEDURE PVDRAW (DU, DIR: INTEGER);
BEGIN
 FOR REP: = 1 TO DU DO
  BEGIN
   PVMOVE(DIR);
   EXDOT
  END
END;
```

```
(* GENERAL VECTOR DRAWER *)
PROCEDURE VDRAW (XE, YE: INTEGER);
BEGIN
 (* PART 1 . . COMPUTE PARAMETERS *)
 DX: = XE - GX;

 DY: = YE - GY;
 IF DX>0
  THEN
   IF DY>0
    THEN
     IF DX>DY
      THEN BEGIN DU:=DX; DV:=DY; MOVE:=0; BREAK:=1 END
      ELSE BEGIN DU:=DY; DV:=DX; MOVE:=2; BREAK:=1 END
    ELSE
     IF DX>-DY
      THEN BEGIN DU:=DX;  DV:=-DY; MOVE:=0; BREAK:=7 END
      ELSE BEGIN DU:=-DY; DV:=DY;  MOVE:=6; BREAK:=7 END
  ELSE
   IF DY>0
    THEN
     IF -DX>DY
      THEN BEGIN DU:=-DX; DV:=DY;  MOVE:=4; BREAK:=3 END
      ELSE BEGIN DU:= DY; DV:=-DX; MOVE:=2; BREAK:=3 END
    ELSE
     IF -DX>-DY
      THEN BEGIN DU:=-DX; DV:=-DY; MOVE:=4; BREAK:=5 END
      ELSE BEGIN DU:=-DY; DV:=-DX; MOVE:=6; BREAK:=5 END;
 VER:=DU DIV 2; (*VER IS DU SHIFTED RIGHT ONE PLACE *)

 (* PART 2 . . GENERATE PV SEQUENCE *)
 FOR REP:=1 TO DU DO
  BEGIN
   VER:=VER-DV;
   IF VER<0
    THEN
     BEGIN
      VER:=VER+DU;
      PVMOVE(BREAK);
     END
    ELSE PVMOVE(MOVE);
   EXDOT
  END;
END;
```

*Fig. 13*

TYPICAL MOVE-BREAK SEQUENCE

```
(* SIMPLE FAST CHARACTER DRAWER *)
PROCEDURE TDRAW(C:INTEGER);
(* C IS AN INDEX TO AN ARRAY WHICH DEFINES THE

SUCCESSIVE ROW PATTERNS . . THE ARRAY IS CALLED ALPHABET *)
BEGIN
 DU:=9;
 DV:=0;
 VER:=0;
 MOVE:=0;
 FOR I:=1 TO 10 DO
  BEGIN
   X:=GX; Y:=GY;


   LDPAT(ALPHABET (C+I-1));
   VDRAW; (* FIG. 13 PROCEDURE, PART 2 ONLY *)
   GX:=X; GY:=Y;
   PVMOVE (6)
  END;
END;
```

FIG. 15(A)
CHARACTER MATRIX
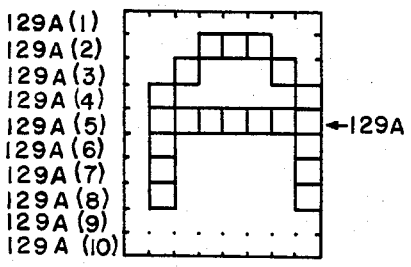
FIG. 15(B)
VECTOR PATTERNS:
| | |
|---|---|
| 129B(1) | 00000000 |
| 129B(2) | 00011100 |
| 129B(3) | 00100010 |
| 129B(4) | 01000001 |
| 129B(5) | 01111111 |
| 129B(6) | 01000001 |
| 129B(7) | 01000001 |
| 129B(8) | 01000001 |
| 129B(9) | 00000000 |
| 129B(10) | 00000000 |
FIG. 15(C)
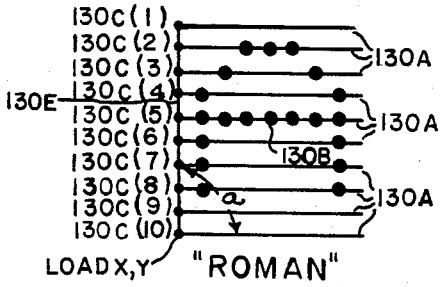
FIG. 15(D)
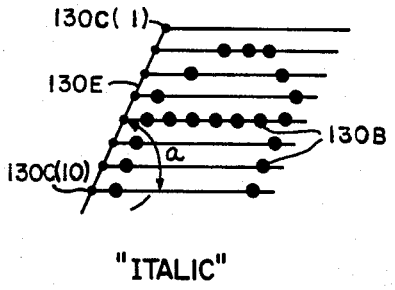
FIG. 15(E)
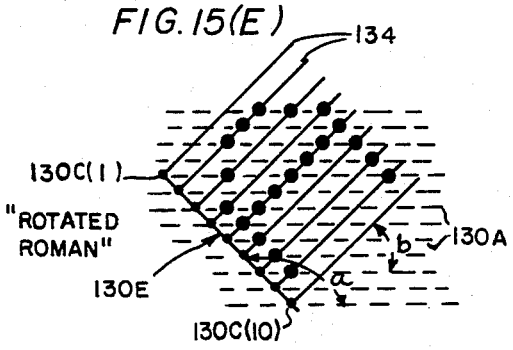

| | | |
|---|---|---|
| LDX | GX <--D | LOAD THE GX COUNTER |
| LDY | GY <--D | LOAD THE GY COUNTER |
| LDPAT | PAT <--D | LOAD THE PATTERN REGISTER |
| LDDU | DU <--D | LOAD THE DU REGISTER |
| LDDVM | DVM <--D | LOAD THE DVM REGISTER |
| LDVER | VER <--D | LOAD THE VER REGISTER |
| LDMODE | MODE <--D | LOAD THE MODE REGISTER |
| LDDIR | DIR <--D | LOAD THE DIR REGISTER |
| LDPMUL | PMUL <--D | LOAD THE PATTERN MULTIPLIER |
| LDPCTR | PCTR <--D | LOAD THE PATTERN COUNTER |

*Fig. 19*

| | |
|---|---|
| EXER<br>MEM [I,J] <-- PAT | SET ALL OF THE REFRESH MEMORY LOCATIONS TO THE CURRENT PAT REGISTER VALUES. THAT IS, ERASE THE MEMORY CONTENTS. |
| EXDOT<br>MEM [GX,GY] <-- F(PAT) | WRITE ONE PIXEL AT THE CURRENT LOCATION AND SHIFT THE PATTERN. |
| EXVEC | WRITE A SEQUENCE OF PIXEL VECTORS USING THE FIG. 13 PROCEDURE AND ACCORDING TO THE CURRENT REGISTER VALUES. |

*Fig. 20*

METHOD AND APPARATUS FOR GENERATING GRAPHIC AND TEXTUAL IMAGES ON A RASTER SCAN DISPLAY

CROSS-REFERENCE TO RELATED APPLICATION

This application is a continuing application from Ser. No. 201,365, filed Oct. 27, 1980 and now abandoned. Applicant hereby incorporates by reference the disclosure of such application to the extent it is not already expressly incorporated herein.

FIELD OF THE INVENTION

The present invention has utility generally in the field of digital systems. More precisely, it addresses the problems of generating images for display on a video display device. Such a video display may be used as a computer output device. The invention is most clearly suitable to a raster-scan display, though it is useful with other types of displays, as well.

OBJECTS AND INTENDED APPLICATIONS OF THE INVENTION

The apparatus and methods disclosed herein are used for generating both graphic and textual images. Though of broad, general utility, they are not intended to be used for all display systems or for generating every conceivable type of two-dimensional image. Rather, the invention is intended to cover a broad but specific range of image-generation applications which roughly require (a) an ability to provide "presentation" level line drawings and (b) fairly general text display capabilities. "Presentation" level line-drawings are the types of graphic images which a user might typically wish to use in a slide presentation, with a quantity of information content and complexity appropriate to such a presentation. Such images include x/y data plots, bar graphs, pie charts, flow charts, block diagrams, room layouts and so forth. In terms of text display capabilities, some or all of the following capabilities are desirable: The ability to vary character size; the ability to select a font from among a variety of alternate and user-definable fonts (foreign language alphabets, mathematical symbols, etc.); the ability to select among character spacing options, including variable uniform spacing of characters on a line, proportional spacing of characters, etc.; the ability to provide italic or other slanting of characters; the ability to write text at angles other than horizontal (such as to label the axis of a graph); subscrips and superscripts; the ability to overstrike characters (such as for certain computer languages and foreign language accents); the ability to place text strings on the display screen at arbitrary locations and the ability to combine the above features arbitrarily.

In addition to being useful for projecting presentations, these features also can be used to advantage in work stations for typeset users, terminals for computer aided instruction and work stations for management personnel.

The ability to display both text and graphics permits (a) the video display to be used to show figures (i.e., art work) integrated with the text, (b) the ability to prepare line art figures on the same terminal as the text portions, and (c) the display of text in much the form as it will take (in terms of size, font, etc.) on typesetting.

Accordingly, it is an object of the invention to provide apparatus for generating both graphic and textual images on a raster scan display, suitable for the uses above-described.

It is a further object of the invention to provide such capability wherein the speed of image generation is a good match to the average speed of transmission of characters on a transmission line from a host computer to the display device.

Yet another object of the invention is to provide such capabilities in a device which is economical to construct and does not overburden or excessively burden a host computer to which it might be attached. These and other objects and advantages of the present invention will be apparent from the description which follows below and explains how the invention achieves such objectives.

BACKGROUND OF THE INVENTION

To illustrate the intended range of applicability of the present invention, it is helpful to divide into several categories the types of images which video display terminals may be capable of presenting. These are listed below, generally in increasing order of complexity.

The most basic type of image is typewriter text consisting entirely of characters found on typical typewriters. These characters are all of the same size and no provision is made for varying the spacing between them. Some very simple types of graphic images may be made available in such machines by building in certain special characters (such as line segments) which can be used to construct boxes, lines and so forth. Examples of such terminals are the models VT52 and VT100 terminals sold by Digital Equipment Corporation of Maynard, Mass.

The next level of image complexity is represented by line graphs. Such images consist of typewriter text plus the ability to present a fixed number of x/y data plots using a fixed number of data representations, such as point plots, bar graphs and line charts. Exemplary terminals with this level of capability are the models VT55 and VT105 terminals, also sold by Digital Equipment Corporation.

A third level of image complexity is represented by images containing typewriter text plus basic line art. Images of this type consist of typewriter text, as defined above, and also allow fairly general line art images such as flow charts, block diagrams, PERT charts, and so forth. The majority of graphics terminals on the market today have this level of capability. Examples are several of the terminals sold by Tektronix Company of Beavertown, Ore., the HP 27XX Family of terminals sold by Hewlett-Packard Company and the IBM 3279 and many Ramtek Corp, terminals.

General line art images represent a next level of complexity. Such images consist of line art drawings, with text to be written in a fairly general fashion. For example, text may be written in a variety of sizes and fonts (including foreign and scientific alphabets). In addition, characters may be displayed in a variety of italic slants, at arbitrary angles, with variable spacing (uniform expansion or contraction of characters on a line), and with proportional spacing (i.e., with spacing between characters in a word, varying according to character width). Characters may also be written by arbitrary overstriking, in subscript and superscript positions, and with a wide variety of other textual features found in textbooks and other typeset documents. The present invention was developed for this level of complexity.

Generally the most complex level of imaging is represented by photographic type images, which are defined as images of a type which any camera is capable of taking. This level of imaging capability is usually used for image processing (i.e., analysis of data taken by actual cameras) and for the development of realistic cartoons and animations.

While various types of electronic display devices are available, the popularity of the raster-scan display has been increasing in recent years, particularly for computer terminal applications. The present invention relates principally to that type of display device. Strictly speaking the term "raster scan" implies that the image is scanned onto the screen surface in a raster sequence—i.e., as a succession of equidistant scan lines, each scan line being made up of a series of picture elements, or pixels. Nevertheless, for purposes of this explanation, other types of displays are included under the heading raster scan, even though no such scanning out takes place, since the invention is not directed at any particular display refresh methodology.

Various architectures are available for creating the pixel pattern on a display. For purposes of comparing the present invention to the prior art, four types of architectures are relevant: fixed character architecture, variable character cell architecture, bit-map architecture, and combined character/bit map architecture.

In fixed character machines (of which current typewriter text level imaging terminals are an example), the visible viewing area of the display is broken up into a coarse grid of C horizontal character positions (or columns) and R vertical text lines (or rows). The values C=80 and R=24 are typical for many of the current machines used for computer programming and general interactive computing. Very simple terminals, such as home computers, have values of these parameters as low as C=24 and R=10, which is consistent with the resolution capabilities of the standard color television receivers which are used as the display devices for many of such machines. The image forming circuitry for these machines generally consists of two memories in a sort of hierarchy. The first, or refresh, memory is a random access memory (RAM) which has one storage location for each of the major grid positions. The second, or character, memory is a read only memory (ROM) which contains the definition of the rectangular pixel arrays used to present the visual pattern defining each of the characters available in the character set. These character patterns are generally referred to as "cells".

In these devices, the image is drawn by writing into each refresh memory location the unique code for the character pattern desired to be displayed at each visual location of the display. For example, if the display is to be shown as a blank "sheet of paper" (i.e., "cleared"), then the code for the blank character is written into each of the refresh memory locations. During the refresh phase of machine operation, which of course takes place continuously, the contents of the refresh memory are read out in sequence from consecutive locations. For each code read out of the refresh memory, the visual pattern for the corresponding cell pattern is read out of the ROM and used to control the intensity of the CRT image by the simple mechanism of turning on the appropriate beam when a cell entry bit is a logical "1" and turning off the beam (i.e., providing a "black" intensity level) when the cell entry bit is a logical "0".

Because of the fixed coarse grid arrangement, this architecture limits the imaging level to typewriter text capability, and the use of a fixed cell definition memory. Character spacing is restricted by the fixed horizontal positions, character size is constrained to the size of the fixed coarse grid size, the display of subscripted characters is prohibited and it is very difficult to display circles and numerous other objects.

The second design approach, variable character cell architecture, involves an extension of the fixed character architecture which allows the presentation of simple line graphs and (in some cases) text plus line art type graphics. In this approach, the number of bits in each of the refresh memory locations is increased so that the hardware can access several possible cell pattern definition memories. Usually one of these cell definition memories is still a ROM, so that the typewriter text image capability is maintained. The other cell definition memories are RAM's; thus a fairly general image may be formed by first writing bit patterns into the redefinable character memories and then writing the codes for these new "character" patterns into the refresh memory at the locations where they are to be shown. For example, to draw a circle on these machines, the circumference of the circle is broken up into sections small enough so that each will fit into the definition of a cell (this may take as many as 100 cells); then the code for each of these cells is written into the refresh RAM at the location where its segment is to be displayed. Visually the pieces of the circle seem to all fit together, and the user is not aware that the image was pieced together.

Variable character cell architecture has the advantage of requiring relatively little memory, but it still limits the presentation of text to the typewriter level. A principal disadvantage to this approach is that the algorithms for drawing the images are generally quite complex. Consider, for example, what happens when two straight lines cross. The definition of the cell must be read out of the memory then modified and written back into the memory. For this reason, the cells for these types of machines are either generated on a host computer or in the local controller of the machine, which is generally relatively slow.

The third basic type of architecture is termed the bit-map approach. These machines take a fairly direct route to forming the image, by eliminating the cell definition memory and making the refresh memory large enough so that each possible pixel location has a corresponding location in the memory. An image for this type of device is drawn by writing a logical "1" into those memory positions for which the image is to be visible or writing the color code into that location in the case of a photographic type image.

This architecture can be used to provide the general text writing features described in relation to the present invention, since characters can be written at any location and at any size. However, the image forming process is relatively slow for normal text writing and considerably more memory and other hardware is required.

Because the display of a photographic type image does not normally require as many horizontal pixels as are needed for displaying 80 columns of text, these machines are often limited to about 512 horizontal pixel locations (about 64 horizontal character locations). Also, the drawing of line art type images is usually faster in these machines than in variable character machines, since the images do not have to be broken up into cell sections.

The fourth of the above-listed approaches involves a combination of the character and bit-map techniques. Such machines attempt to get the advantages of both the relatively low cost and speed of the fixed character architecture and the general capability and display versatility of the bit-map approach; they do this by simply combining the two machines into one and "or-ing" the image produced by each part into one visible image. This approach is typical of many of the more advanced computer terminals which are currently available. The relative disadvantages are that it becomes difficult to maintain registration between images written using the bit-map section and text characters whose locations are constrained by the character grid. Further, the text displayed is limited to typewriter text.

Digressing briefly, it should be understood that each of the foregoing approaches to display generation is the best choice for certain types of applications and certain levels of cost. In this regard, the present invention fills an important gap between the limited character-oriented machines and the general bit-map machines for many applications where very general text and graphics capabilities can be used to advantage. Such applications include, but are not limited to, the preparation of reports which require the integration of text and drawings, charts and the like, and the making of formal presentations, wherein the more general text capabilities provided by the invention can be used to enhance visual interest. Among other things, display mathematical formulas and the like which are difficult to generate with the simpler afchitectures are easily displayed with this architecture.

SUMMARY OF THE INVENTION

The present invention involves an architectural design for a display apparatus capable of presenting both graphic and textual images. It is a modification of.bit-map architecture and is particularly well suited to raster scan displays.

In contrast to the character/bit-map combination, the present invention utilizes simpler image-forming circuitry, since there is only one image-forming circuit, instead of two. Further, text can be written at speeds comparable to those provided by the fixed character approach. Also, both text and line art images are written by the same mechanism, so there is no problem in keeping these parts of the display registered in their proper relative positions; they are not spliced together.

According to the invention, images are formed in a refresh memory entirely by the execution of sequences of "pattern modulated" line segments termed "vectors". There are two sequences of vectors generated for writing each character cell (i.e., two-dimensional matrix) into the refresh memory. The first, or outer, sequence provides the starting position and pattern for each of the vectors (i.e., line segments) in a second, or inner, sequence. The inner and outer vectors are generated, respectively by inner and outer vector generators. Both inner and outer vectors are drawn from a current, starting position in a selected direction to an end point position a given length away, based upon the contents of definable registers in the image generating hardware. The vector generators select the appropriate points intermediate the starting position and the end point position which is a known distance away. One of the registers, called the pattern (PAT) register, identifies the data to be written into the successive pixel locations in memory selected by the vector generators during the writing of each line segment.

The architecture also allows the writing process to be reversed, so that data may be read from the refresh memory into the PAT register; the processor can thereby access arbitrary data from the memory.

The approach to drawing characters in the present invention is simply to break the overall two dimensional character pattern into a set of nested one-dimensional patterns, which can be related to columns and rows. Each row of the character pattern (i.e., matrix) is drawn by executing an inner vector at an angle and length selected for the cell. The vector length is set equal to the width of the character and other variables are set appropriately to generate the desired angle. A second vector generating procedure is used to create a vector which, instead of providing illumination points, provides the starting (X,Y) ldcation to be used for drawing each successive row in the matrix. This vector, too, has a starting location, length, spatial orientation (i.e., an angle), and a pattern. The system for writing a two-dimensional "cell" into the refresh memory thus involves the generation of two sequences, one nested within the other. The "outer" sequence is a vector which provides a starting location for each vector "drawn" by the "inner" sequence; each element of the inner sequence is a row vector. The angle of the outer vector can be set independently of the angle of the inner vector. By a particular sequence of generating pattern modulated vectors, almost any desired character pattern may be constructed in the refresh memory. The direction, repetition, and location of these sequences may be varied dynamically, creating the ability to vary the size, direction (i.e., angular orientation) and spacing of characters, as well as the fonts, plus providing a number of other text enhancements.

BRIEF DESCRIPTION OF THE DRAWING

These and other features objects and advantages of the present invention will be better understood from the following detailed desciption read in conjunction with the accompanying drawing in which:

FIG. 9 is a listing in the PASCAL computer language describing the process for drawing a straight line horizontally to the right from a starting location, with length DU number of pixels, according to the invention;

FIG. 10 illustrates a procedure for causing the coordinates GX, GY to be changed by one pixel in the major compass direction defined by the parameter DIR;

FIG. 13 is a listing of a procedure for drawing a vector (i.e., line segment) at an arbitrary angle, using the rate multiplier approach of the present invention;

FIGS. 15A, 15B, 15C, 15D and 15E are illustrations of character drawing according to the present invention, showing how the letter "A" is stored in memory and how it may be formed in the refresh memory without transformation or in italics or written at a slanted direction, for example;

FIG. 19 illustrates the minimum instructions according to the general image generation instruction set for register read and mode operations; and FIG. 20 lists the minimum instructions according to the general image generation instruction set for pixel sequence operations.

DETAILED DESCRIPTION

From the viewpoint of system structure, the present invention is intended primarily for use in terminals which serve as input/output devices for computer systems. Most frequently, such terminals use serial interface lines in communicating with the computer. The present invention is well suited to such systems, since the speed of image generation it provides is a good match to the average speed of transmission of characters on the transmission line, assuming the use of a high level graphics language protocol.

This apparatus also may be used in stand-alone terminals in which the graphics and extended text capabilities are accessed either by a higher level graphics language or by direct sub-routine reference to a lower level, but higher speed instruction set discussed below.

Figure 1:
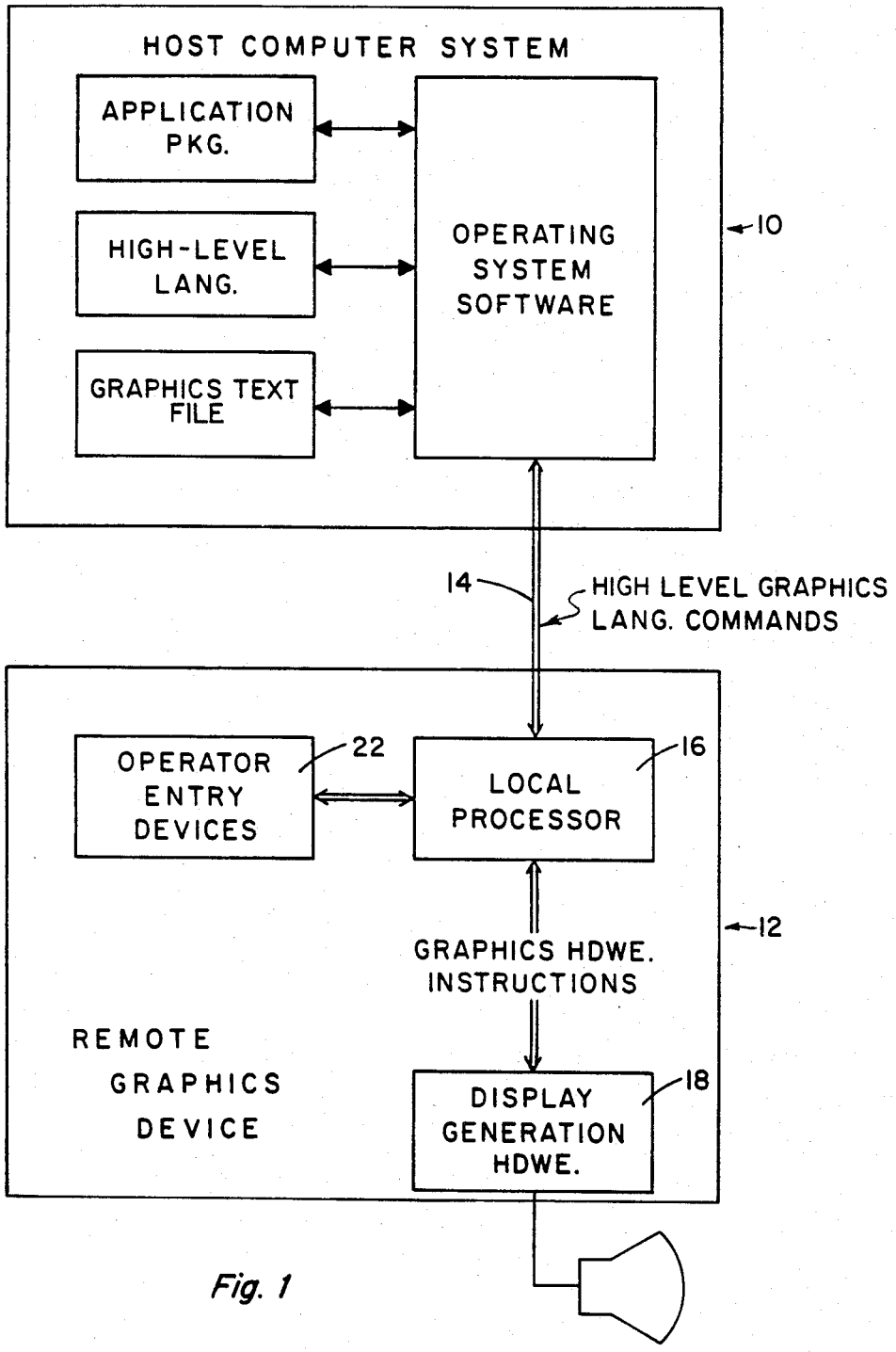
FIG. 1 is a high level block diagram of a system in which the architecture of the present invention is used in a terminal for remote hook-up to a host computer system.

FIG. 1 illustrates a high-level block diagram of a system in which the architecture of the present invention is used in a terminal for remote hook-up. The system as a whole consists of a host computer system 10 and a remote graphics device 12 incorporating the invention. The host computer system 10 provides a stream of high level commands which are sent to the remote terminal 12 over serial interface 14 (which may, for example, include telephone data transmission lines). Within the remote graphics device 12, the high level commands are interpreted and converted by a local processor 16 into lower level commands which are understood by and directly executed by the display generation hardware 18 (alternately referred to herein as the "image generator"). Other entry devices, such as keyboards and digitizers may be connected as at 22, to local processor 16, as a means for preparing and presenting visual images, as well.

Figure 2:
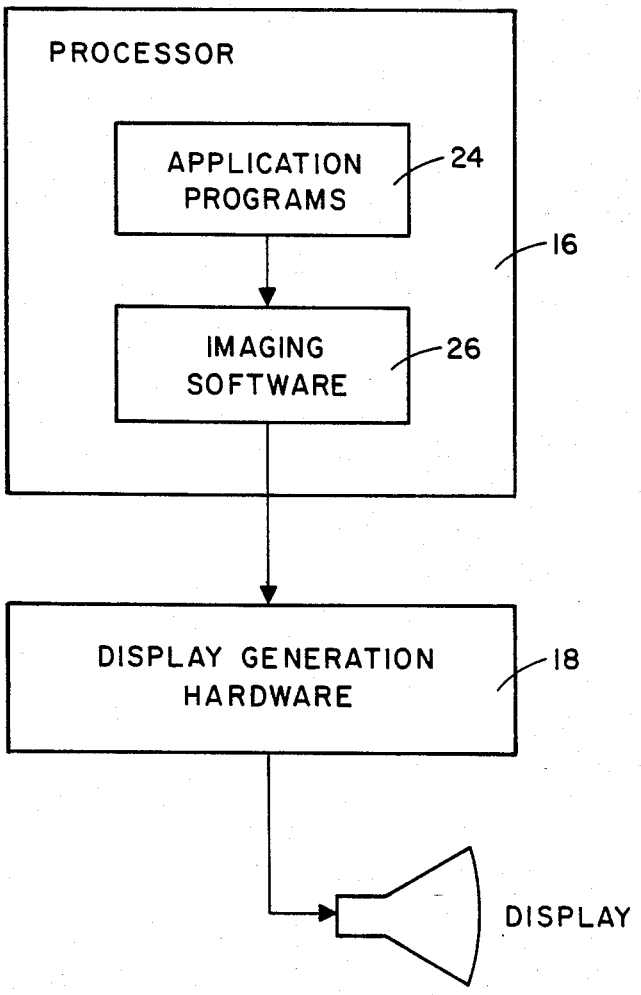
FIG. 2 is a high level block diagram of a system utilizing the architecture and hardware of the present invention in a stand-alone terminal.

FIG. 2 illustrates a high level block diagram of a system utilizing the architecture and hardware of the present invention in a stand-alone terminal. The principal difference from the system shown in FIG. 1 is that the local processor 16 in the stand-alone terminal must execute the higher level software as well as control the display generation hardware 18. For that reason, the image generation process may be slower on the average than for the case shown in FIG. 1. This deficiency may be overcome to achieve a system of even greater performance than the remote case, by the direct use of the lower level instructions. From an architectural point of view, such an application could also use an intermediate level, macro-instruction set instead of the low-level instructions sent directly to the display generation hardware 18. The macro-instruction set would be provided by application programs 24 and converted into the lower level instruction set by imaging software 26. The advantage in using the macro-instruction set is the elimination of the time-consuming overhead of interpreting the higher level language character streams, while allowing the user to take advantage of a high level language format (i.e., commands, etc.). This is preferable to using the lower level instruction set directly, since that instruction set has to be optimized at the software/hardware interface to a degree that does not support the direct generation of single characters or an arbitrary end point line image.

Figure 3:
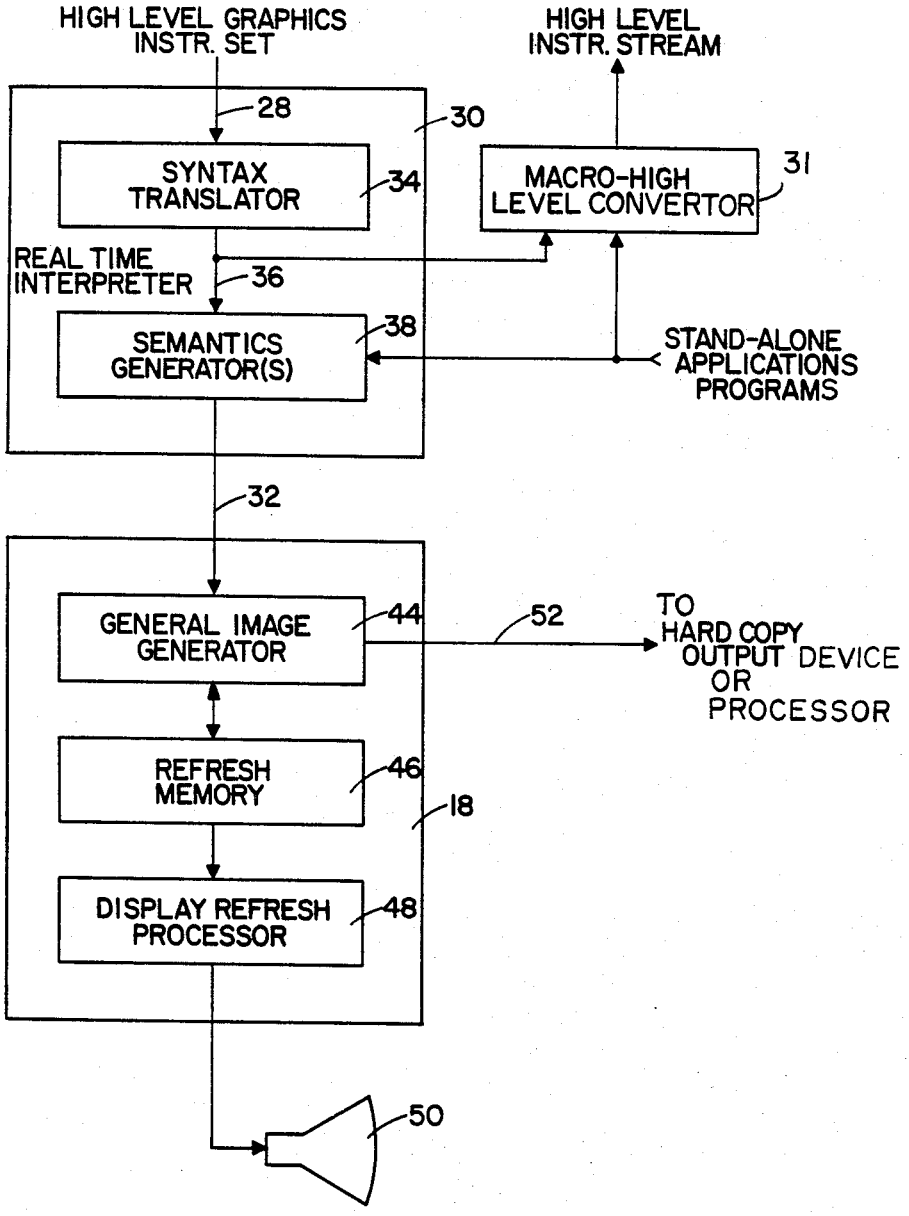
FIG. 3 is a more detailed block diagram illustrating the flow of operation in apparatus based on the architecture of the present invention.

FIG. 3 provides a more detailed diagram illustrating the flow of operations in apparatus based on the present invention. This illustration is applicable to both the remote terminal and stand alone terminal situations. The general flow of operation is as follows:

First, a stream of instructions in a high (i.e., user) level graphics language is provided on line 28 by a host computer, keyboard or other source. That instruction stream is received by a real-time interpreter 30 formed by processor 16 and associated commonly-understood hardware and software. The output of the real-time interpreter 30, on line 32, comprises a stream of instructions in a so-called "general image generator" instruction protocol or language which is understood by the display generation hardware 18. Thus the graphics image may be stored and transmitted in the same higher level graphics instruction set used for communications on line 28.

A syntax translator 34 converts the user level instructions received on line 28 to macro-instructions, which are provided on line 36. In turn, a semantics generator 38 converts the macro-instructions to the low level instructions which are recognized by the display generation hardware 18 and are provided to it on line 32.

The macro-instructions on line 36 are also provided to a macro-to-high-level converter 31; consequently, the graphic images in this system can be based on a single, higher-level language facility. The protocol generated by the macro-to-high level converter 31 must be consistent with the protocol provided on line 28. Of course, the requirement of standardization on such a single higher-level language restricts the level of the instruction set on line 28 to one compatible with the ability of converter 31 to construct the same syntax and semantics.

In FIG. 3, the display generation hardware 18 is shown broken down into a general image generator 44, refresh memory 46 and display refresh processor 48, which feeds a display device, such as CRT 50. General image generator 44 uses unique "pattern modulated vector" operations (described below) to write into the refresh memory 46 dot patterns for characters and sequences of line segments for drawing curves and filling areas. To select the appropriate dot patterns, general image generator 44 utilizes the values of parameters which are established in various registers by appropriate instructions, and the "character call" selection indicated in the high level graphics instructions. (Such registers and their operation will be explained below.)

For the purpose of providing hard copy output of the image currently stored in refresh memory 46 to a hard copy screen dump device, or for detailed modification of the refresh memory contents by a local applications program, the general image generator 44 is capable also of reading the contents of the refresh memory 46 and of sending this information back to a hard copy output device or to the controlling processor, which communication is indicated generally at line 52.

On a continuous basis, display refresh processor 48 reads the refresh memory 46 and drives the display 50 with the memory's contents, to maintain the visual impression of the currently defined image. The general image generator 44 and the display refresh processor 48 have equal accessiblity to the refresh memory, on a time-shared basis. However, whereas the display refresh processor 48 usually must read the refresh memory in a fixed order (e.g., raster sequence), the general image generator 44 may access the memory in any sequence.

The display refresh processor 48 generates a serial stream of information in either digital or analog form, to drive a display device such as a device capable of displaying a raster image. For the purposes of the discussion which follows, certain conventions are adopted with respect to that raster. It shall be assumed hereinafter that the raster image is displayed by a sequence of horizontal lines starting from the top of the display. Further, each line is displayed from left to right. Each possible pixel position is given a unique physical x,y position on the display device and has a corresponding logical x,y position in the refresh memory.

The operation of the display refresh processor under the raster scan convention used herein starts by reading data from the refresh memory at location row (i.e., y)=0 and column (i.e., x)=0. The y value is maintained at this value during the display of the first line, and the x value is incremented until all the defined x values for that line have been read out of memory. The y value is then incremented and the process is repeated starting with a value of x=0. In turn, the line readout process is repeated until all of the defined lines have been readout, at which point the y value is returned to 0 and the process is repeated. By contrast, the general image generator 44 is capable at any instant of modifying the information and attribute values of a pixel at arbitrary x,y coordinates. When a pixel value is changed in memory, its new value is displayed the next time the display refresh processor reads that location. Thus, the image appears to change visually at the rate by which the general image generator hardware modifies the refresh memory, which may be very rapidly (as is the case when clearing the screen, for example) or more slowly.

It will be understood now that the architecture of the present invention is very flexible and that a wide variety of devices can be used to implement display device 50, simply by changing the parameters of the memory size and display refresh process. Thus, such devices would include low resolution binary level black and white displays, full tone black and white monitor displays, high resolution black and white monitors, binary level RGB color or television displays (using only the primary and complementary colors to generate the display), and full tone color images on high resolution color devices. The cost of increased quality and quantity of information display is proportional to that increased capability, by way of increasing the number of memory devices used in the refresh memory.

As used herein, the term "architecture" is intended to indicate the specification of the overall structure of the system at the processor memory switch (PMS) level, the levels of language in the system and the instruction set processor (ISP) definition at each level, and the set of registers and register transfers available.

The Set of Macro-Instructions

As described earlier, the invention utilizes a set of macro-instructions designated as a general image macro-instruction set. This set of instructions comprises a group of routines callable by applications programs; the routines are semantically equivalent to the high-level instructions normally supplied by the user or host computer over line 28, but use of the macro-instructions provides some speed-up in operation since the overhead of syntax translation from the high-level instructions to the macro-instructions is avoided. The specific form of macro-instructions is to some degree dependent on the applications language used. For purposes of illustration, therefore, the following function definitions are offered; these are typical of what such subroutines would look like for use with languages such as FORTRAN, BASIC and PASCAL.

The instruction CLEAR (XL, YU, XR, YB) clears the screen and sets the screen coordinates to be (XL, YU) at the upper left hand corner of the screen and (XR, YB) at the lower right hand corner of the screen. If the parameters XL, YU, XR and YB parameters are all zero, then the screen coordinates are not changed.

The command BCOLOR(c) sets the background color to intensity C.

The instruction POSITION (XREL, X, YREL, Y) sets the current writing position to the X, Y values defined by the command parameters. The XREL and YREL parameters are integers which indicate whether the X and/or Y position arguments are relative or absolute; a non-zero value for XREL indicates relative positioning and a zero value indicates absolute positioning. The sign of XREL for a non-zero value indicates the relative direction with respect to the current screen coordinate definition. If XREL is positive and X=0, then the X position component is not changed.

The instruction BEGINP sets a marked position to be returned to later.

The instruction ENDP sets the current writing position to the X,Y values defined by the command parameters.

The instruction PIXELP(PV) performs a pixel vector move in the direction PV (see FIG. 13, part 2). Similarly, macro-instructions may be provided for drawing a vector (i.e., an approximation of a straight line from the current writing position to the position defined by the command parameters).

Other macro-instructions may be provided for numerous additional functions, such as drawing curves, changing the mode of writing (e.g., reverse mode, overwriting, etc.), drawing circles, drawing characters from other ones of the available alphabets, defining text writing options, creating character sets, etc.

All of these instructions are executed by various sequences of the general image generation instruction set.

A Minimum Embodiment

For purposes of discussing a basic machine constructed according to the present invention, it will be assumed that the size of the screen matrix is 256 horizontal pixels by 256 vertical pixels. To further simplify matters, it will be assumed that the device can display only binary black and white; thus no memory is required for storing screen attributes (e.g., shades of gray, color, underlining, and the like). The refresh memory 46 contains $256\times256=65{,}536$ storage locations which are addressed by a 16-bit number. Each of the unique 16-bit addresses corresponds to a visible pixel point on the display; the address is formed by combining an 8-bit X address with an 8-bit Y address. By convention, the address $X=0$ and $Y=0$ represents the upper left hand corner of the display (i.e., the "home" position), $X=255$ represents the right hand margin and $Y=255$ represents the bottom margin.

It will further be assumed for this basic machine that the display refresh processor 48 is required to supply successive pixel values serially from the refresh memory 46 at a rate of one pixel every Tp seconds. (Tp typically is on the order 10–200 nanoseconds.) By design, the invention requires the use of memories which allow two accesses for each pixel cycle of Tp seconds. One of these accesses is allocated for use by the display refresh processor 48 to read the pixel needed at the current position on the screen. The other memory access during each cycle is used by the general image generator 44 to either read a memory location, write into a memory location or perform a combined read and write operation on a specific memory location.

Figure 4A:
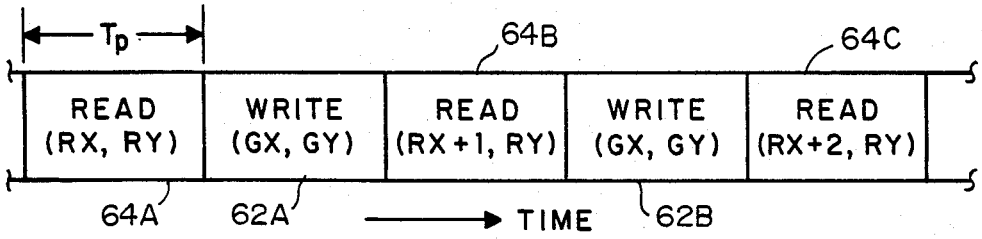
FIG. 4A and 4B are timing diagrams illustrating the sharing of the refresh memory between the refresh and image generation processors.
Figure 4B:
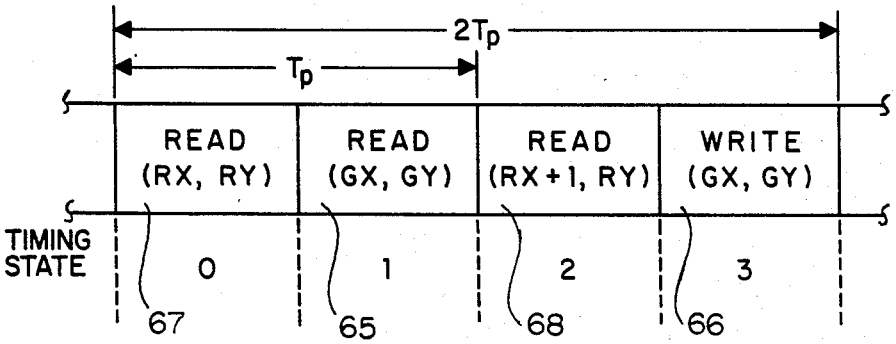

Let (RX, RY) represent the address which the display refresh processor 48 uses to access the successive locations in the refresh memory 46. Letting the general image generator 44 address the memory 46 at coordinate (GX, GY), a typical timing sequence for the use of the memory is illustrated in FIGS. 4A and 4B. These figures show the basic sharing of the memory 46 between the refresh and image generation processors, and the possible variations of this time-sharing within the context of the invention's architecture. In FIG. 4A, the display generation hardware 18 performs an equal number of write operations 62A, 62B for the equivalent number of refresh read operations 64B, 64C. By contrast, as shown in FIG. 4B, the display generation hardware 18 may perform one read operation 65 and one write operation 66 for each two successive read operations 67, 68 of the display refresh processor.

Figure 5:
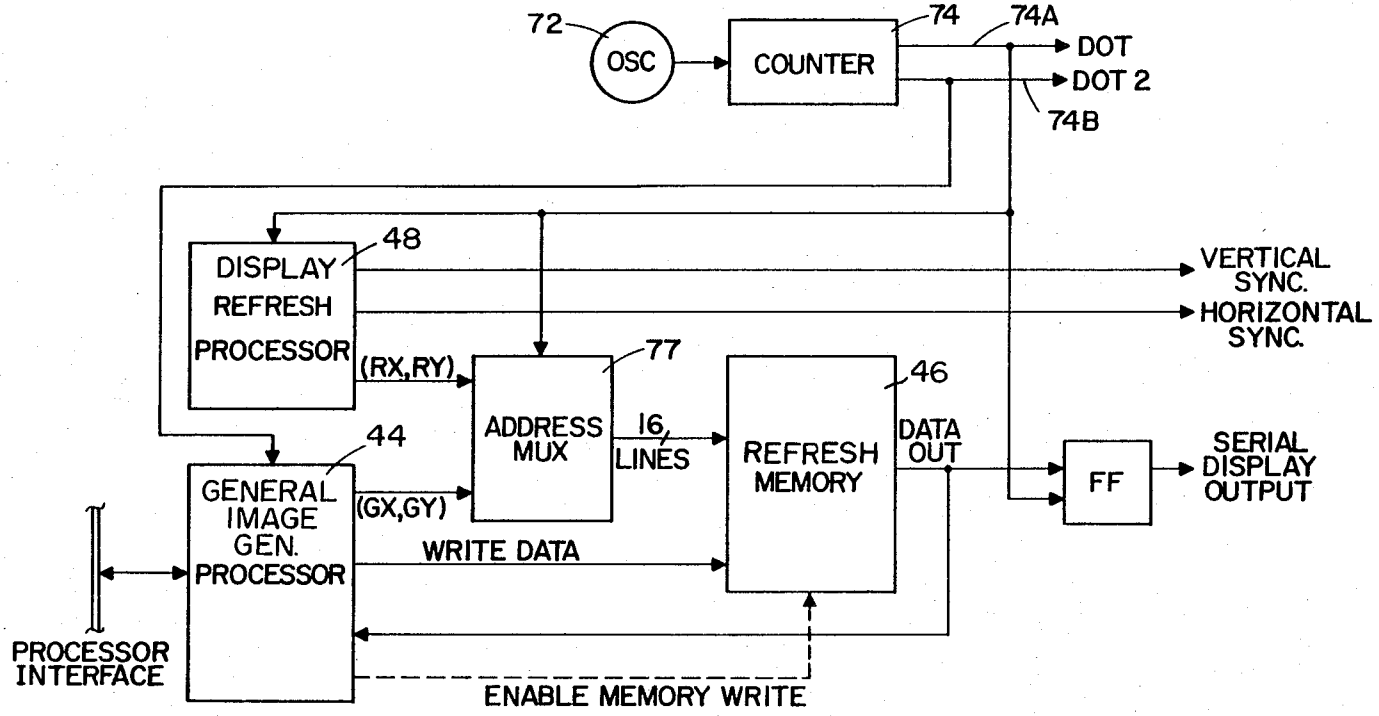
FIG. 5 illustrates a block diagram describing the relationship between the refresh memory, the display refresh processor and the general image generation processor, including the multiplexing of the refresh memory between the two processors.

In the more complex machine discussed below as an alternative embodiment, the display generation hardware generally needs to read the memory and rewrite it after a delay of one Tp cycle. This time-sharing of the memory is accomplished by a multiplexer circuit which, in its simplest form, is shown in FIG. 5. The basic timing of the system is provided by an oscillator 72 which generates one pulse every Tp/2 seconds. The signal from oscillator 72 is counted down in a counter 74 which provides timing signals to define four states to the memory-sharing cycle. Those four states are illustrated in FIG. 4B, also. In the first state (count=0), the refresh memory's bit value at (RY, RX) is read and displayed by refresh processor 48. In the second state (i.e., count=1) the display generation hardware 18 reads the bit value at (GY, GX). In the third state, (i.e., count=2), the refresh memory's bit value at (RY, RX+1) is read and displayed. Finally, in the fourth state, (i.e., count=3), the display generation hardware 18 writes the bit value for (GY, GX) to the refresh memory 46. This basic cycle continues indefinitely.

In FIG. 5, the two bits of output from counter 74 needed to define the four basic machine states are labelled DOT and DOT2, and are provided on lines 74A and 74B, respectively. These four counter states are used by both the display refresh processor 48 and the general image generation processor 46 to determine when to generate the proper addresses for accessing refresh memory 46. The DOT2 signal (i.e., the basic clock divided by two) directly defines the address to the multiplexer 77. The display refresh processor 48 uses the memory 46 exactly half of the time and the image generation processor 44 uses the memory 46 the other half of the time.

Figure 6:
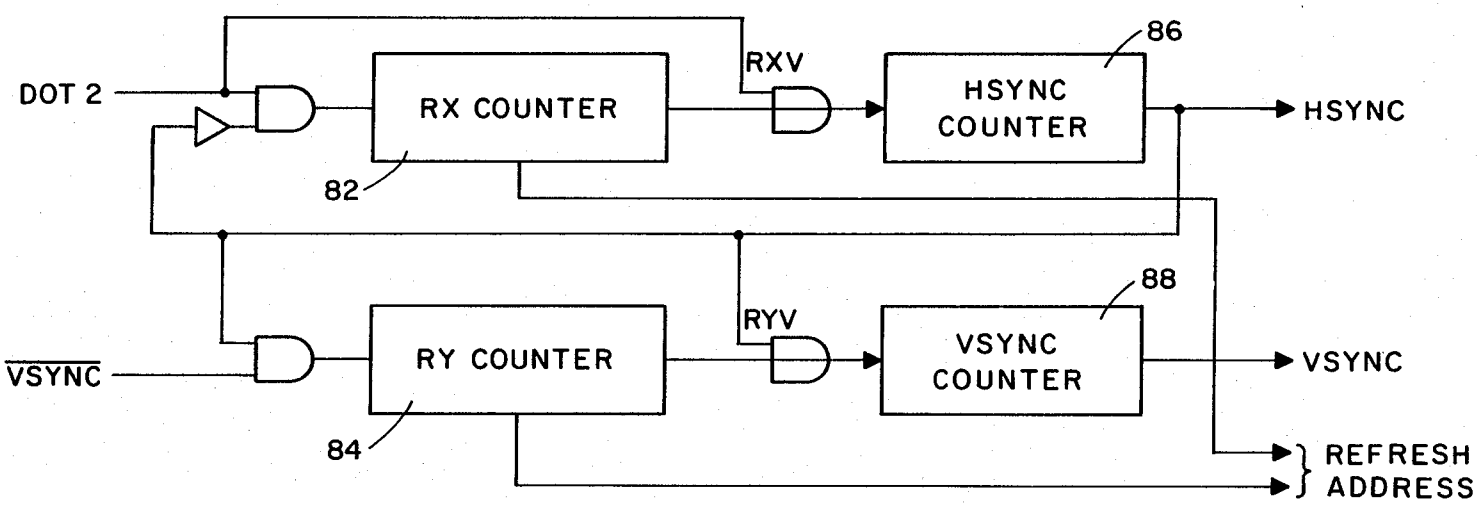
FIG. 6 is a block diagram illustrating the counters needed to generate the horizontal and vertical synchronization signals and the RX, RY coordinates for the display refresh processor to read the refresh memory.

The display refresh processor 48 also generates vertical sync (VSYNC) and horizontal sync (HSYNC) signals. Those signals are used by the display device 50 to determine when to start a new line of the display and when to move the visible position to the home position. For a very simple machine, such as discussed in this section, the display refresh processor 48 may be implemented by using a commercially available integrated circuit such as the Motorola 6845 VATG (Video Address and Timing Generator). FIG. 6 illustrates a simplified circuit which accomplishes the basic operation of any such display refresh processor. The circuit consists of four counters, 82-88. The RX and RY counters 82 and 84, respectively, generate the respective coordinates of successive memory refresh addresses, while counters HSYNC and VSYNC (86 and 88, respectively) generate the delays needed by a physical display device to actually move the current display position to either the beginning of a new line (HSYNC) or to the home position of the display (VSYNC).

The basic operation is a continuous cycle beginning with the RX and RY counters 82 and 84 cleared (i.e., RX=0 and RY=0) and the HSYNC and VSYNC counters 86 and 88 also cleared. The RX counter 82 is incremented on each occurrence of the DOT clock signal, causing successive horizontal pixels to be read from the refresh memory 46 and shown on the display 50. This cycle continues until all of the horizontal positions on the current RY-valued line have been displayed, at which time the RX counter generates an overflow signal, RXV, which causes the HSYNC counter 86 to begin counting. The RX counter 82 is disabled during this time and the HSYNC signal is generated for the duration of the HSYNC counter cycle.

As soon as the appropriate number of horizontal sync time pulses have been counted by the HSYNC counter, the HSYNC signal is disabled and the RX counter 82 is enabled to count again, beginning at a count of 0 and continuing until the RY counter 84 is incremented by 1. This cycle continues until all of the lines have been displayed, at which time the RY counter 84 generates an overflow signal, RYV causing the VSYNC signal to be generated and causing the VSYNC counter 88 to begin counting additional line counts.

After the appropriate number of delay counts (the multiple of the time required for the RX cycle to complete), the VSYNC counter overflows, the VSYNC signal is dropped and the process begins again with all the counters having a value of 0.

The horizontal and vertical delay times have no effect on the operation of the image generator hardware. The general image generator 44 continues to perform its operations on the refresh memory 46 independent of the operation of the display refresh processor 48, except for the time multiplexing of the memory which continues whether the data output is used for a display or not. The read operations of the refresh process which occur during the HSYNC and VSYNC time operations are not used for display purposes, but may be used for more complex refresh process operations as described below.

Pixel Writing

Figure 7:
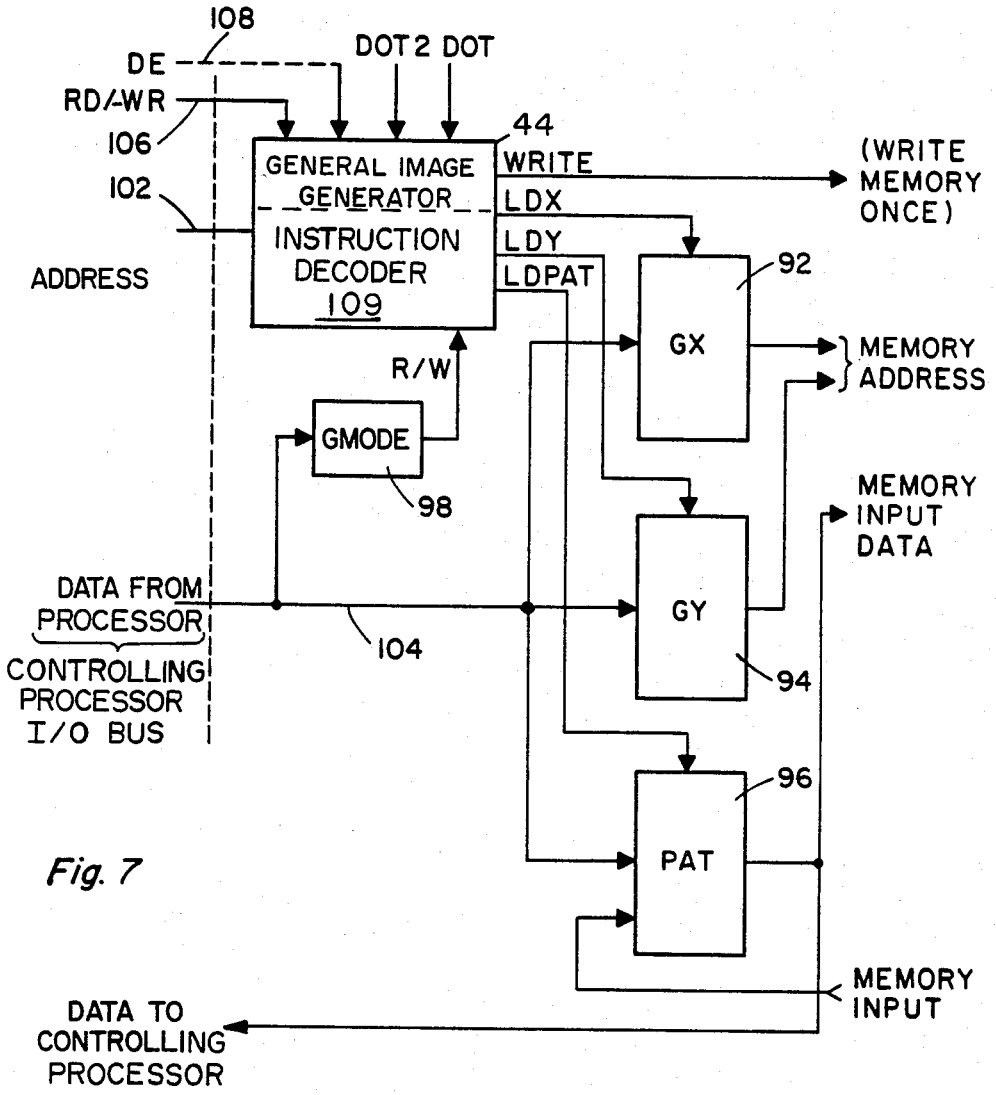
FIG. 7 illustrates in block diagram form the basic registers used in the present invention for single pixel writing, and their relationship to each other.

With this background, the basic registers of the general image generator processor 44 will now be defined and the basic timing for writing a single pixel will be developed. As shown in FIG. 7, the writing of a single pixel at a location (GX, GY) in the refresh memory 46 requires the use of four registers, called the GX, GY, PAT and GMODE registers and labelled as elements 92, 94, 96 and 98, respectively. The contents of the GX and GY registers 92 and 94 define the location in the refresh memory 46 to be written or read; the contents of the PAT register 96 define the value of the data to be written into the refresh memory or the value of data read from the memory; and the contents of the GMODE register 98 define whether data is to be read from or written into the refresh memory.

FIG. 7 also illustrates the basic interface to the controlling processor. The exact nature of this interface varies depending upon the exact requirements of the processor used, but generally consists of the following signal lines: (1) a set of controller-generated addresses, indicated at line 102; (2) a set of data input lines 104; (3) a read/not write signal (RD/−WR), supplied on line 106; and (4) a device enable signal line (DE) 108.

A subset of all possible addresses presented on line 102 is uniquely defined for use by the display generation hardware processor; instruction decoder 109 within general image generator 44 identifies which of the instructions is to be executed.

Data input lines 104 may be bidirectional to allow both data output and data input, and are used to supply data to the display generation hardware processor. The RD/−WR signal on line 106 tells the display generation processor that data is to be either read (value=1) or that an instruction is to be executed (value=0).

The device enable signal (DE) on line 108 tells the display generation processor that it is the one processor amongst all processors which is to respond to the instruction read or write operation.

Based upon the foregoing four registers, five of the basic low-level image generation language instructions can be defined. The first instruction, LDMODE, loads the GMODE register 98 from the controller input data. The second instruction, LDX, causes the GX register 92 to be loaded with the data from the controller. The third instruction, LDY, similarly causes the GY register 94 to be loaded with the data from the controller. Likewise, the fourth instruction, LDPAT, loads the pattern register 96 from the controller input. Fifth, an instruction termed EXDOT causes the data value in the PAT register 96 to be written into the refresh memory 46 at the location specified by the GX and GY registers at the fourth state (when the display generation hardware writes to the refresh memory) of the next basic refresh memory cycle, provided that the GMODE bit is one; otherwise, the data at the location (GX, GY) is read into the PAT register at the second state (i.e., count=1) of the next refresh memory cycle.

Since all of these basic operations are generally executed in a time which is short compared to the time that the controller processor executes one instruction, an arbitrary sequence of such instructions may be executed to draw an arbitrary image on the screen. Further, since the GX, GY and PAT registers are loaded by separate instructions, any register which does not change value between successive EXDOT operations does not have to be reloaded.

These basic instructions are sufficient to generate all of the images possible in the basic machine. However, the primitive nature of these instructions is such that the software in the controller would spend far too much time performing trivial tasks. By contrast, the display generation hardware is busy doing operations only a small percentage of the time relative to the controller operations, thus creating a situation in which the rate at which a new image may be drawn on the screen is much less than the hardware allows. Under the timing scheme disclosed above, the machine is capable of changing the display at a rate of $\frac{1}{2}$Tp pixels per second. In practice, the average rate of screen modification using only these instructions is on the order of 1% to 5% of this maximum value. It is therefore a desire to provide a structure which allows the screen to be updated at much more efficient rates by optimally increasing the amount of hardware utilized in executing more complex operations and, therefore, decreasing the amount of work that the processor must perform by executing software. The goal is to have the hardware busy performing useful image generation functions during the interval that the processor is working to figure out what operation is to be performed next in the hardware. In practice, it has been found that the hardware structure disclosed below achieves 50–80% efficiency with minimal addition of hardware.

One approach to implementing the more capable hardware is just to implement the macro-instruction set as defined earlier. While this accomplishes what is desired, it turns out that in practice the processor software spends a lot of time waiting for the hardware to complete its operation, thus creating another less than optimal situation. A better approach, therefore, is to implement an intermediate level of capability through the use of a low-level general image generation instruction set, which allows low cost with maximum performance. In summary then, the present invention implements the translation from macro-instruction to general image generation instruction set in software, while implementing the transformation from general image generation instructions to primitive dot writing operations in hardware.

Vector Writing

Figure 8:
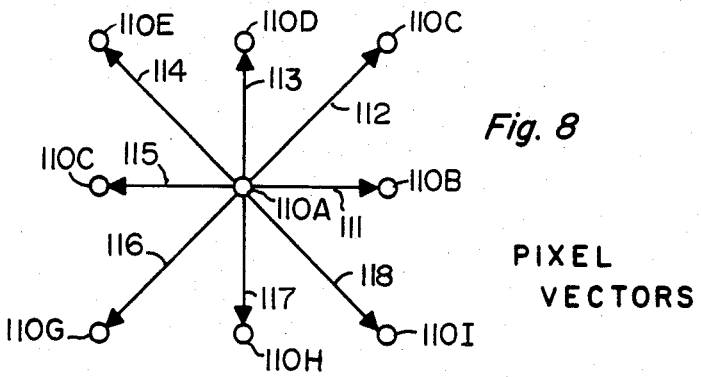
FIG. 8 is a diagram showing the eight pixel vector directions used by the vector generator.

The simplest type of line to draw is one in which the cursor of the display is moved in one if the eight major directions of the compass—i.e., from a starting pixel to its closest neighboring pixel in one of those diresctions. These eight directions are referred to as pixel vectors and are illustrated in FIG. 8 by the arrows 111–118, drawn from the center pixel 110A to each of its neighboring pixels (shown as circles) 110B–110I at the heads of the arrows 111–118, respectively.

The simplest type of vectors to draw consist of solid straight lines drawn in one of the foregoing eight major directions. Using an abbreviated form of the PASCAL computer language as a mechanism to describe hardware operation, FIG. 9 describes the process for drawing a straight line horizontally to the right with length DU number of pixels. The vector (the term "vector" is used herein to refer to a finite segment of a line) starts at location (X,Y), and the functions LDX(n), LDY(n) and so forth all refer to the primitive instructions defined above. The variable REP is a loop control variable.

Similar procedures may be defined for writing vectors of any length in the other seven major directions, but it is more efficient to define one procedure which draws in any one of these directions, by exploiting symmetry. Such a procedure, called PVMOVE(DIR), is listed in FIG. 10. It causes the values of X and/or Y to be changed by one pixel as determined by the value of a variable called DIR. DIR is a number having a value in the range 0–7, corresponding to the major compass directions 111–118, respectively, as defined in FIG. 8. The value of DIR thus is the vector designation in FIG. 8, minus 111.

Using this new function, one procedure may be formed for drawing a straight line in any of the eight major directions based upon the parameter (DIR). This procedure assumes that the vector is to be drawn in direction DIR from the current position (GX, GY), using the current value of the PAT register and with a length DU. The procedure, called PVDRAW, is listed in FIG. 11. Note that this procedure does not draw the first pixel at the initial location (GX, GY), as the convention adopted herein is that the initial pixel of a vector is not drawn; if the first pixel is to be drawn, then the EXDOT instruction must precede the procedure of FIG. 11.

Figures 11, 12:
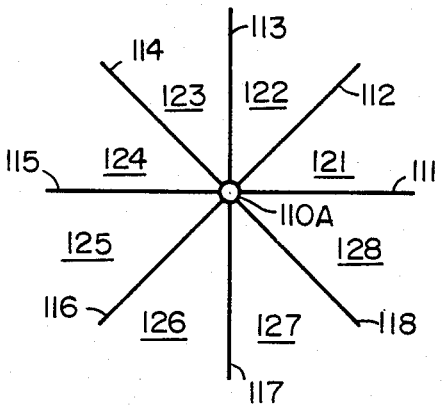
FIG. 11 is a listing of a procedure for drawing a straight line in one of the eight major directions of FIG. 8, using the procedure of FIG. 10.
FIG. 12 is a diagram of the eight octant areas or regions created between the eight major pixel vector directions of FIG. 8.

The use of the PVDRAW procedure of FIG. 11 is sufficient to draw a wide variety of box type figures, but lacks the generality necessary to draw angularly disposed vectors. To draw such line segments, the present invention utilizes a variation of what has been called a "rate multipler." Of course, any image constructed on a device which uses a rectangular grid of pixels cannot be drawn with exact straight line except for lines parallel to the grid coordinate system. The rate multiplier approach provides an approximation to a straight line which is the best that can be accomplished using that grid. If the device has a sufficiently high resolution, then the line will be of high quality.

The procedure is simplified by taking advantage of symmetry. The sequence of pixel vectors needed for drawing an arbitrary vector between the current position (GX, GY) and the desired end position (XE, YE) is similar for vectors drawn in different "octants" if the absolute values of (XE−GX) and (YE−GY) are the same. These octants, illustrated in FIG. 12 by the numerals 121–128, generally refer to the areas between the eight major pixel vector directions 111–118. One way of viewing the general angular vector process is to consider the approximation as just being the drawing of the vector in the direction of the nearest major axis (horizontal or vertical) with "occassional" modifications which cause the pixel vector sequence to steer toward a diagonal line. The more that the sequence is modified by a diagonal pixel vector, the greater the angle of the line. For a specific vector, it turns out that the total pixel vector sequence is comprised of pixel vectors in only two directions: one pixel vector along one of the horizontal or vertical directions (which will be called a "MOVE" pixel vector) and a pixel vector along an adjacent diagonal which will be called the "BREAK" pixel vector direction.

Figures 14, 16:
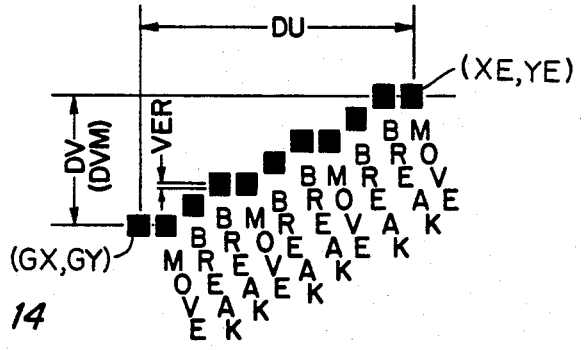
FIG. 14 is an illustration of an example of the execution of the procedure of FIG. 13 to draw a vector from (GX,GY) to (XE, YE)
FIG. 16 lists a procedure for constructing character patterns according to the invention.

There are two major stages to drawing a vector at an arbitrary angle using the rate multiplier approach. In the first stage, the values of five variables are determined. These are (1) DU, the total number of pixel vectors to be written; (2) DV, the number of times that the "BREAK" pixel vector is to be drawn, which is never larger than DU; (3) MOVE, the direction of the MOVE pixel vector; (4) BREAK, the direction of the BREAK pixel vector; and (5) VER, the vector error which accummulates over the sequence and determines when the BREAK pixel vector is to be drawn rather than the MOVE pixel vector. The second stage of the procedure uses those parameters to generate the actual sequence of pixel vectors needed to approximate the line segment. The full procedure is listed in FIG. 13; an example of the execution of this procedure is illustrated in FIG. 14, for the construction of an arbitrary line segment. In the example of FIG. 14, a vector is drawn from (GX, GY) to (XE, YE). A total of 10 pixel vectors are written (i.e., DU=11); the BREAK vector is written in the diagonal direction six times (i.e., DV=6), the MOVE vector is written in the horizontal direction four times. The starting pixel at location (GX, GY) is drawn by the EXDOT routine.

The procedure shown in FIG. 13 is a variation of the so-called Bresenham's algorithm which is explained, for example, in W. Newman and R. Sproull, *Principles of Interactive Computer Graphics* (2d ed.) at 25–27.

Line Patterns

The procedure of FIG. 13 is sufficient to construct the majority of line-art type drawings. It is desirable, however, in using line art patterns, to be able to distinguish different types of lines on the same figure. This is accomplished in the present invention by requiring the PAT register to be a shift register of MAXPAT bits in length. Into this register a pattern of binary 1's and 0's is loaded initially, the binary pattern representing a dash/space sequence, with the 1's indicating dashes and the 0's indicating spaces. Each time or multiple of times that the EXDOT operation is performed, this register is shifted, so that successive binary values are presented for writing into the refresh memory. By shifting the output data back into the input of the shift register, the shifting pattern is maintained independent of the length of the vector sequence. And by not changing the value of the PAT register between successive arbitrary vector operations, the line pattern is maintained, even around corners of the vector sequence being written.

"Character Drawing"

The approach to drawing characters in the present invention is simply to break the overall two dimensional character pattern into a set of nested one-dimensional patterns. An illustration is provided in FIGS. 15(A-)-15(E) using the letter "A" as an example.

In FIG. 15(A), a character matrix (i.e., cell) 129A is shown for drawing the letter "A". The character cell represents the character as it is stored in a character memory. A character may be an alphanumeric symbol or any graphic pattern which can be formed by the selective display of dots in the two-dimensional matrix. As shown, the character cell is formed of 10 rows by 8 columns. The character cell is transformed by the general image generator 44 into a sequence of vector patterns in the display refresh memory 46. The details of the transformation are governed by the values of the parameters which have been supplied to the general image generator. The vector pattern 129B(1)-129B(10) for each row of the matrix (129A(1)-129A(10), respectively) appears in FIG. 15(B); there, a zero represents a blanked screen and a one indicates an illuminated screen. Each row of the character pattern is drawn by executing the general vector generation procedure. Thus rows of characters may be drawn at any angle, at a length selectable separately for each cell. The vector length, DU, is set equal to the width of the character (including inter-character spacing); DV and VER are set appropriately to generate the proper angle; and the MOVE and BREAK parameters are selected to identify the octant in which the row is to be written. The PVDRAW procedure of FIG. 13 is then executed with the PAT register set appropriately for each row, on a row-by-row basis.

A second vector generating procedure is used to create a vector which, instead of providing illumination points, provides the starting (X,Y) location for each successive row in the matrix. This vector, too, has a starting location, length, spatial orientation (i.e., an angle), and a pattern. Consequently, the system for writing a two-dimensional "cell" or "matrix" into the refresh memory 46 involves the generation of two sequences of parts, one nested within the other. The "outer" sequence is a vector which provides a starting location for each vector "drawn" by the "inner" sequence; each element of the inner sequence is a row vector. The angle of the outer vector can be set independently of the angle of the inner vector. This enables character cells to be enlarged, slanted, rotated, or altered by a combination of those operations.

Three simple examples of the transformations which can be accomplished by the general image generator are shown in FIGS. 15(C)-15(E). In those figures, the display screen is shown; the display, of course, corresponds to an appropriate portion of the refresh memory, except that the image is written in the memory as 1's and 0's, not as illuminated and non-illuminated display points. With this distinction in mind, FIGS. 15(C)-15(E) may be thought of as showing the refresh memory; this is preferable, since in explaining the generation of the points which are displayed, reference will be made to the points determined by the vector generation process.

In FIG. 15(C), the letter "A" is displayed in simple (i.e., upright non-slanted, non-rotated) roman form. The lines 130A represent the scan lines of the display; the larger blackened dots (only one of which 130B is labelled) indicate points illuminated to form the cell being displayed. The smaller blackened dots 130C(i) represent row starting positions in the character matrix, mapped onto corresponding pixel positions on the display screen. The pixel position 130D at the lower left corner of the character cell represents the X,Y coordinates assigned to the character cell itself.

As stated above, two nested vector generators map each point in the character matrix 129A to a bit value in an appropriate location in refresh memory 46. The first vector generator provides a series of starting locations 130C(1)-130C(10) for each of the vectors created by the second vector generator. This series of points 130C(1)-130C(10) lie along a line 130E defined as or by the "outer" vector. For each row in the matrix, an "inner" vector is generated. In FIG. 15(C), these inner vectors lie along the (i.e., are coincident with a portion of) scan lines 130A and are at right angles to the direction 130E of the outer vector. In general terms, though, the orientation of the inner and outer vectors can be varied at will; they need not be vertical and horizontal and they need not be normal to each other. For example, in FIG. 15(D), the direction of just the outer vector is changed, such that line 130E is slanted; this produces an italic drawing of the letter "A" from the cell matrix of FIG. 15(A). Using the horizontal scan line direction as a reference, the direction of the outer vector is disposed at an angle "a" with respect thereto. The angle "a" is set in accordance with the general vector drawing procedures set forth above. In FIG. 15(E), the direction of the "inner" vectors 134 is altered, also, so as to line at an angle "b" with respect to scan lines 130A. Consequently, the letter "A" is rotated. For simple rotation, as illustrated, angles "a" and "b" are complements; if angles "a" and "b" are both non-zero and are also non-complementary, the cell will be both rotated and slanted (not shown). In effect, both slanting and rotation are accomplished by writing into the refresh memory successive points along inner vectors 134, as they are generated, with the X and Y counters addressing corresponding locations in the refresh memory for storing each pixel; and then reading out from the memory in raster sequence, along the directions of scan lines 130A.

If the size of the PAT register is eight bits and it is desired to draw a character in its normal horizontal orientation without italic slanting (as in FIG. 15(C)), and the size of the character cell is $9\times10$ (including a one column inter-cell space, which is assumed but not illustrated in FIGS. 15(A)-15(E), then the procedure illustrated in FIG. 16 is sufficient to construct the character pattern. Of course, once the vector parameters are set up, only the second part of the general FIG. 13 procedure is used. Successive characters are drawn on a reference line by setting the GX and GY registers to the appropriate values which represent the upper left hand corners of each new character position. From FIG. 16, the origin of the terms "inner" and "outer" vector will become apparent, by reference to the inner and outer loops by which the character is drawn.

A variety of text writing features are made possible simply by changing the various parameters and extending the foregoing procedure. For example, character width may be varied. Width may be set to an amount WIDTH times the normal, by setting DU to WIDTH times the normal number of pixels in the width of a character and by only shifting the PAT register after every WIDTH number of EXDOT operations. Character heights may be varied by repeating the execution of the VDRAW step in the FIG. 16 procedure a number of times equal to the variable HEIGHT, without changing the value of the PAT register. (The PAT register may need to be reloaded between each repetition.) Character rows may be drawn at any angle by the appropriate selection of the DV, VER, MOVE and BREAK parameters. An interesting property of the general vector procedure is that the value of the VER variable is the same at the completion of drawing a vector as it was at the beginning, so its value need be set only once for the complete drawing of the character or a sequence of characters all of which have the same angle.

A variety of spacing features such as proportional spacing, subscripting and so forth are accomplished similarly, by computing the successive character start point positions by different procedures, depending on the features desired.

Basic Curve Drawing

The preferred approach to curve drawing in the present invention is to use short line segments to approximate portions of curves. This provides a mechanism for drawing curves at reasonable speeds without requiring additional hardware. Further, this approach is capable of the same level of approximation quality as many of the more specialized curve-drawing techniques.

Area Filling

The present invention allows a variety of area filling procedures to be used by first reading the memory, making the appropriate modifications, and writing the data back into the memory. This is generally a slow process. A high percentage of the time the area to be filled represents geometric images bounded by rectangles, triangles and circles and general convex polygons and curves. For these cases, the architecture of the present invention provides a relatively fast mechanism for filling areas, a technique called "reference shading." In this technique, a reference Y position is selected; this position is called YSHADE. All subsequent vector operations (including vectors used to approximate curves, thus allowing curve images to be filled also) are carried out in a two dimensional manner very similar to what was described for character pattern drawing. By contrast with character drawing, the "rows" are always drawn vertically and with a length which is the difference between the current GY value on the vector and the YSHADE value. By using successive row patterns from a character pattern definition, and repeating this pattern when necessary, the area may be filled with an arbitrary two-dimensional pattern.

Naturally, it should be understood that apparatus constructed according to the present invention may provide horizontal, as well as or instead of vertical, drawing and filling.

Registers

Figure 17:
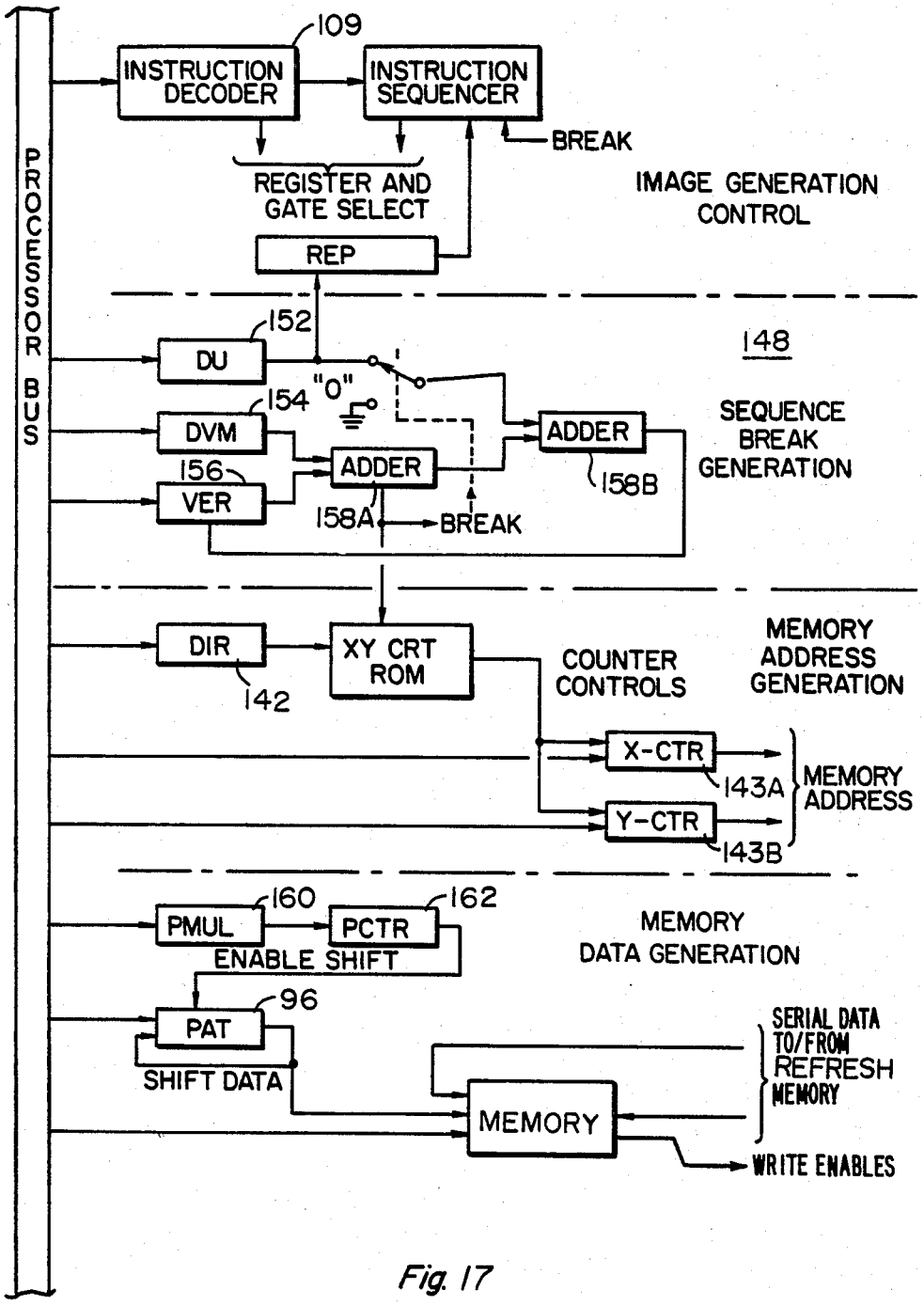
FIG. 17 is a block diagram illustrating the minimum register configuration for the display generation hardware of the present invention.

Based on the desire to provide a minimum hardware system but with reasonable performance, the minimum hardware register set necessary to implement the above-described primitive functions will now be described, with reference to FIG. 17.

The GX and GY register 92 and 94 counters are, of course, necessary to supply successive addresses to the refresh memory to write the pixel information defined by the low-level image generation instructions.

The PAT shift register 96 is also necessary. It must be writable and, for some optional capabilities, readable. The PAT register is used to modulate the data written into the refresh memory during a sequence of successive pixel vector operations.

These registers permit execution of the general EXDOT operation, which is used as the basis for all imaging in the invention.

The hardware also supports a direction (DIR) register 142 which identifies the direction the counters are to move for a pixel vector operation.

A repetition (REP) counter register 144 determines the number of times that a basic pixel MOVE vector and EXDOT operation is to be performed. With the addition of this facility, the hardware is capable of executing arbitrary length vector drawing operation in the major directions.

A BREAK generation circuit 148 which includes the registers DU (152), DVM (154) and VER (156) and an adder circuit (158A,B) together are used to accomplish the second part of the general vector drawing procedure, illustrated in FIG. 13. The direction (DIR) register 142 in this case is used to identify the octant within which the vector is to be drawn and controls the counting of the GX and GY registers 92 and 94 as a function of the BREAK signal generated by the BREAK generation circuit. That is, the DIR register 142 causes the MOVE direction (major direction of the octant) to be executed in the absence of the BREAK signal, and causes the BREAK direction (diagonal direction of the octant) to be executed for a pixel vector execution in which the BREAK signal is present. Thus, the DIR register identifies the direction the X and Y counters 143A, 143B are to move for a pixel vector operation.

A pattern multiplier 160 (PMUL) and pattern counter 162 (PCTR) comprise a register pair which determines how often the pattern register (PAT) 96 is to be shifted relative to the pixel vector writing sequence. The PAT register modulates the data written into the refresh memory during successive pixel vector writing operations. This supports the drawing of arbitrarily sized line patterns and character rows.

Basic Timing

Figure 18:
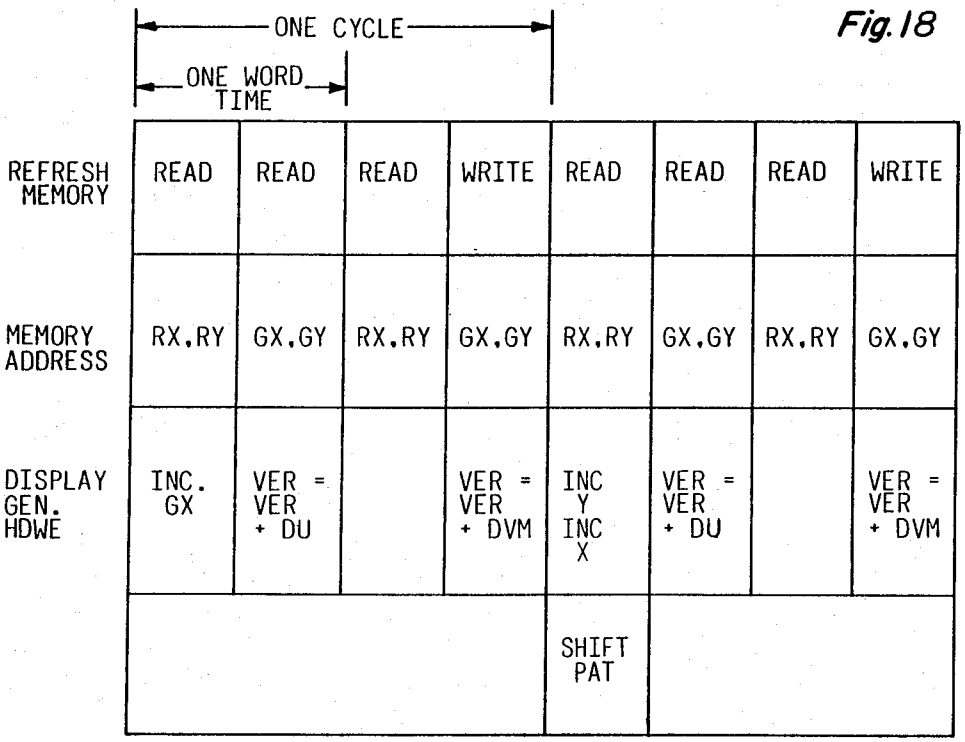
FIG. 18 is an illustration of the basic timing and memory sharing for the process of drawing successive pixels into the memories of the present invention, showing also one possible sequence of register transfers for BREAK circuit computations.

The basic timing and memory sharing for the process of drawing successive pixels into the memories is illustrated in FIG. 18. Also shown there is one possible sequence of register transfers for the BREAK circuit computations.

General Image Generation Instruction Set

There are basically two types of low level image generation instructions which the display generation hardware can execute: (1) register read and load operations and (2) pixel sequence operations. Control of whether a register is to be read or loaded is based upon the processor bus signals which identify the operation. FIG. 19 lists the minimum instructions in this category. The parameter "D" in all cases represents the data supplied by the controlling processor as part of the instruction. It will be observed that there is no instruction for loading the REP counter 144. In all instructions which use the REP counter, that counter is loaded initially with the current value in the DU register 152. Further, some of these register load operations may be combined; typically, the LDPCTR instruction is combined with the LDPMUL instruction.

In the illustrations, it is assumed that all register load instructions are executed in unit time relative to the controlling processor. That is, the controlling processor may arbitrarily issue a sequence of these instructions without checking a BUSY status flag (i.e., bit) which indicates when the display generation hardware is actually executing an instruction.

The second category of instructions, pixel sequence operations, are also referred to as the EXECUTE instruction category. For this category, data sent with the instruction normally is not used. The minimum instruction set for the EXECUTE instruction category is indicated in FIG. 20. For the case of the EXER and EXVEC instructions, a BUSY flag is set during execution of the instruction; the controlling processor must generally monitor this flag to ensure that the display generation hardware has completed its operations before continuing to issue additional instructions.

Reduction in Memory Requirements

In many applications of a graphic device it is not necessary for one dimension of the display to have the same resolution (in terms of pixels per unit distance) as the other dimension. For example, in applications involving mostly textual characters, the vertical resolution requirement is generally half the horizontal resolution requirement.

It is a principle of the current invention to take advantage of this lessened resolution requirement by generating the successive pixels of a vector in such a manner that only half of the usual amount of memory is needed. This is accomplished, for example to reduce the memory in the vertical direction by one half, as follows. If each vertical line is numbered, then any pixel which is to be written on an odd numbered line is simply written into the next lower even numbered line. The result is vectors (i.e., lines) which still appear visually to be properly connected.

Naturally, various improvements, modifications and alterations of the methods and apparatus disclosed herein will readily occur to those skilled in the art. Accordingly, this disclosure is intended to be exemplary, not limiting, and the invention is intended to encompass all such obvious improvements, modifications and alterations; the invention is thus limited only as defined by the following claims.

What is claimed is:

1. Apparatus for generating an image on a display device from a two-dimensional image matrix, comprising:

A. a display refresh memory for storing information correspondence to each picture element to be displayed on the display device;

B. display refresh means for supplying to the display device the information stored in the refresh memory; and C. general image generator means for writing to the display refresh memory a pattern of picture elements to be displayed on the display device, the general image generator means including (1) first and second means for generating, respectively, outer and inner sequences of pattern modulated vectors, each pattern modulated vector, in turn, being a sequence of points having a predefined pattern and comprising a line segment having a specified length, starting position and angular orientation relative to the display device, (2) the first pattern modulated vector means generating outer vectors whose points define the starting positions for each of the inner vectors generated by the second pattern modulated vector means, and the pattern for each such inner vector, and (3) the second pattern modulated vector means generating, for each starting position defined by the outer vectors, a vector comprising an illumination pattern for a succession of picture elements lying along the inner vector and defining the picture elements to be displayed therein.

2. The apparatus of claim 1 wherein the the display device is a raster scan device and the display refresh means reads information out of the display refresh memory in raster sequence.

3. The apparatus of claim 2 wherein the orientation of at least one of the sequences of vectors generated by the first and second pattern modulated vector means is variable independently of the orientation of the other sequence of vectors generated by the first and second pattern modulated vector means, whereby the information corresponding to the image contained in said matrix may be a slanted transformation of the matrix.

4. The apparatus of claim 3 wherein the orientation of the vectors generated by the first pattern modulated vector means is variable independently of the orientation of the vectors generated by the second pattern modulated vector means, whereby the information corresponding to the image contained in said matrix may be a rotated transformation of the matrix.

5. The apparatus of claim 2 wherein the orientation of the vectors generated by the first pattern modulated vector means is variable independently of the orientation of the vectors generated by the second pattern modulated vector means, whereby the information corresponding to the image contained in said matrix may be a rotated transformation of the matrix.

6. Apparatus for generating from a two-dimensional image matrix arranged into rows and columns a display thereof consisting of a transformation of the image recorded in said matrix, such apparatus comprising:

means for generating from each of a set of first points to a corresponding second point a pixel illumination pattern to be displayed corresponding to a row of said image matrix;

means for generating the locations of successive ones of said first points, corresponding to the starting positions for the pixel illumination pattern for each row;

the means for generating the locations of successive ones of said first points being adapted to locate such succession of points along a line segment of any assigned angular orientation, starting location and length; and the means for generating pixel illumination patterns and the means for generating the successive locations of such first points being operable independently, whereby through selection of appropriate successive locations for said first points, the matrix may be transformed for display in differing sizes, slants and rotations.

7. The apparatus of claim 6 wherein the representation of an image matrix is generated in a refresh memory from which the display is generated.

8. Apparatus for generating from a two-dimensional image matrix arranged into rows and columns a display thereof consisting of a transformation of the image recorded in said matrix, such apparatus comprising:

means for generating a pixel illumination pattern to be displayed from each of a set of first points to a corresponding second point, such pattern corresponding to a column of the image matrix;

means for generating the locations of successive ones of said first points, corresponding to the starting positions for the pixel illumination pattern for each column, including means for locating such succession of points along a line segment of any assigned angular orientation, starting location and length; and the means for generating pixel illumination patterns and the means for generating the successive locations of such first points being operable independently, whereby through selection of appropriate successive locations for said first points, the matrix may be transformed for display in differing sizes, slants and rotations.

9. The apparatus of claim 8 wherein the representation of an image matrix is generated in a refresh memory from which the display is generated.

10. Apparatus for generating from an image matrix a representation on a two-dimensional display of the image contained therein, comprising:

means for generating a first pattern-modulated line segment from a first point on the display to a second point on the display, including line segment generator means for establishing the picture element positions on the display intermediate the first and second points where the line segment is to be displayed; and means for generating an ordered of set of data which specifies the location for each of said first points and (b) for each such first point, a pattern for the line segment to be displayed between each said first point and its corresponding second point.

11. The apparatus of claim 10 further including:

pattern generator means for determining the information to be displayed at each of the intermediate locations of the line segments, such pattern generator means including a shift register and means for loading the shift register with a pattern of 1's and 0's representing the selection of information to be displayed at each location; and means for shifting the shift register contents by one position responsive to the writing of a predetermined number of display locations.

12. Apparatus for generating a two-dimensional image of an object from a stored representation of the object, the size, orientation and slanting of the image all being variable to allow generation of images of differing size, orientation and slanting from the stored representation of the object, such apparatus comprising:

A. first and second means for generating line images between starting points and ending points, each such line image generator including (1) location counters used for selecting locations to be displayed intermediate said starting points and said ending points, (2) an octant register connected to control the incrementing and decrementing of the location counters, (3) a pair of registers (DU and DV) whose contents represent the angle of a line within the octant defined by the contents of the octant register, (4) an error register which contains, for each display location between the starting and ending points the relative error between the location of a straight line between the starting and ending points and the location represented by the contents of the location counters for such display location, and (5) an adder operatively connected to the error register and said pair of registers (DU and DV) such that (a) the incrementing and decrementing of the location counters is responsive to an overflow signal from the adder in association with the contents of the octant register, and (b) after each display location is selected, the output of the adder is loaded back into the error register for use in selecting the next display location, and B. the first line image generator means further comprising means for selecting for display at each display location a digital word from among a repetitive sequence of digital word patterns from a fixed array of word patterns;

C. the second line image generator means further comprising a pattern shift register and counter means for controlling which locations are to be changed; and D. the first and second line image generator means being connected such that the first line image generator (1) sets the starting points for lines drawn by the second line image generator and (2) selects a word pattern for each use of the second line image generator.

* * * * *